US010174468B2

(12) United States Patent
Eby, Sr.

(10) Patent No.: US 10,174,468 B2
(45) Date of Patent: Jan. 8, 2019

(54) CULVERT PIPE INLET

(71) Applicant: Craig A. Eby, Sr., Cadillac, MI (US)

(72) Inventor: Craig A. Eby, Sr., Cadillac, MI (US)

( * ) Notice: Subject to any disclaimer, the term of this patent is extended or adjusted under 35 U.S.C. 154(b) by 0 days.

(21) Appl. No.: 15/420,712

(22) Filed: Jan. 31, 2017

(65) Prior Publication Data

US 2017/0218581 A1 Aug. 3, 2017

Related U.S. Application Data

(60) Provisional application No. 62/290,639, filed on Feb. 3, 2016.

(51) Int. Cl.
*E01F 5/00* (2006.01)
*E02B 11/00* (2006.01)
*E03F 1/00* (2006.01)

(52) U.S. Cl.
CPC ..... *E01F 5/005* (2013.01); *E02B 11/005* (2013.01); *E03F 1/00* (2013.01); *E03F 1/003* (2013.01)

(58) Field of Classification Search
CPC ..... E01F 5/005
USPC ..... 405/124, 125; 404/2–4
See application file for complete search history.

(56) References Cited

U.S. PATENT DOCUMENTS 625,795 A * 5/1899 Nichols ..... E01F 5/005 405/125
1,048,153 A * 12/1912 Haight ..... E01F 5/005 405/125
1,228,662 A * 6/1917 Good ..... E01F 5/005 405/125
1,258,751 A * 3/1918 Dean ..... E01F 5/005 405/125
1,620,089 A * 3/1927 Fischer ..... E01F 5/005 405/125
1,652,703 A * 12/1927 Cushman ..... E01F 5/005 118/DIG. 10
2,263,588 A * 11/1941 Odendahl ..... E01F 5/005 405/125
2,800,925 A 7/1957 Tollefsen et al.
2,958,200 A * 11/1960 Russell ..... E01F 5/005 405/125
3,048,983 A 8/1962 Crummel
3,636,830 A 1/1972 Watts
5,358,007 A 10/1994 Carlberg
6,240,680 B1 6/2001 Estes
D447,543 S * 9/2001 Quin ..... D23/259
D447,544 S * 9/2001 Quin ..... D23/259
6,533,498 B1 * 3/2003 Quin ..... E01F 5/005 405/124
6,805,359 B2 * 10/2004 Neuhaus ..... F16L 5/02 277/576
7,425,105 B2 9/2008 Grimes
7,736,090 B2 6/2010 Janesky
2006/0033330 A1 * 2/2006 Neuhaus ..... F16L 5/02 285/230
2008/0138156 A1 6/2008 Janesky

OTHER PUBLICATIONS

Menards, 15" HDPE Culvert Apron, (Oct. 5, 2013).*

* cited by examiner

*Primary Examiner* — Frederick L Lagman
(74) *Attorney, Agent, or Firm* — Kristin L. Murphy; Brooks Kushman P.C.

(57) ABSTRACT

A culvert pipe inlet arrangement includes a pan member and an inlet that is configured to be disposed within a culvert pipe is disclosed.

13 Claims, 4 Drawing Sheets

CULVERT PIPE INLET

CROSS-REFERENCE TO RELATED APPLICATIONS

This application claims the benefit of U.S. provisional application Ser. No. 62/290,639 filed Feb. 3, 2016, the disclosure of which is hereby incorporated in its entirety by reference herein.

TECHNICAL FIELD

The present disclosure relates to culvert arrangements, and more particularly to a culvert pipe inlet that permits the entire flow of water entering into an end section of a pipe of a culvert inlet or downspout to prevent slope erosion and wash out.

BACKGROUND

Downspout pipes and culvert inlets experience a reoccurring problem with respect to accommodating water runoff from roadways and ditches. More specifically, current designs require metal end sections to be installed with the unit wrapping around the outside of a pipe. As a result, this installation allows for water to flow between the outside of the pipe and the metal end section and follow the grade down the pipe causing the materials used to cover the pipe to wash away. This wash causes slope erosion and can develop into an unsafe condition for the roadway. These conditions also result in high maintenance costs and wasted man-hours repairing the same location repeatedly. What is needed is a culvert arrangement that reduces slope erosion and requires less frequent maintenance efforts.

SUMMARY

In one exemplary arrangement, a culvert pipe inlet arrangement for culvert pipes is disclosed that comprises an inlet section and a pan member. The inlet section is connected to the first end of the pan member. The inlet section has a diameter less than an internal diameter of a culvert pipe such that the inlet section is configured to be received in frictional engagement with an interior surface of the culvert pipe.

In another exemplary arrangement, a culvert pipe inlet arrangement for use with culvert pipes comprises a pan member, an inlet section and a sleeve. The pan member is defined by first and second ends and a body portion between the first and second ends. The inlet section is connected to the first end of the pan member, but has a continuous diameter. The sleeve has first and second ends, wherein the first end is smaller than the second end such that the sleeve is tapered, and wherein the second end of the sleeve is secured to the inlet section.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 2:
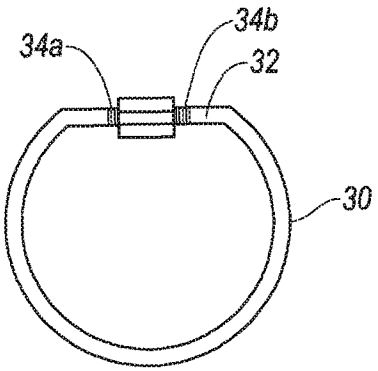
FIG. 2 is a plan view of a band member for the culvert pipe inlet arrangement of FIG. 1.
Figure 3:
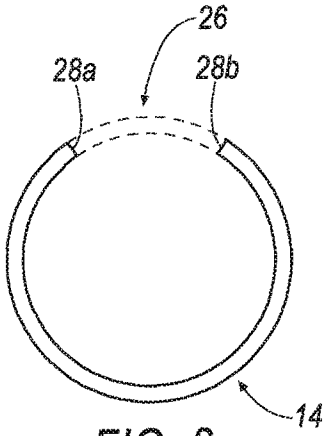
FIG. 3 is a plan view of an inlet section of a culvert pipe inlet arrangement of FIG. 1.
Figure 1:
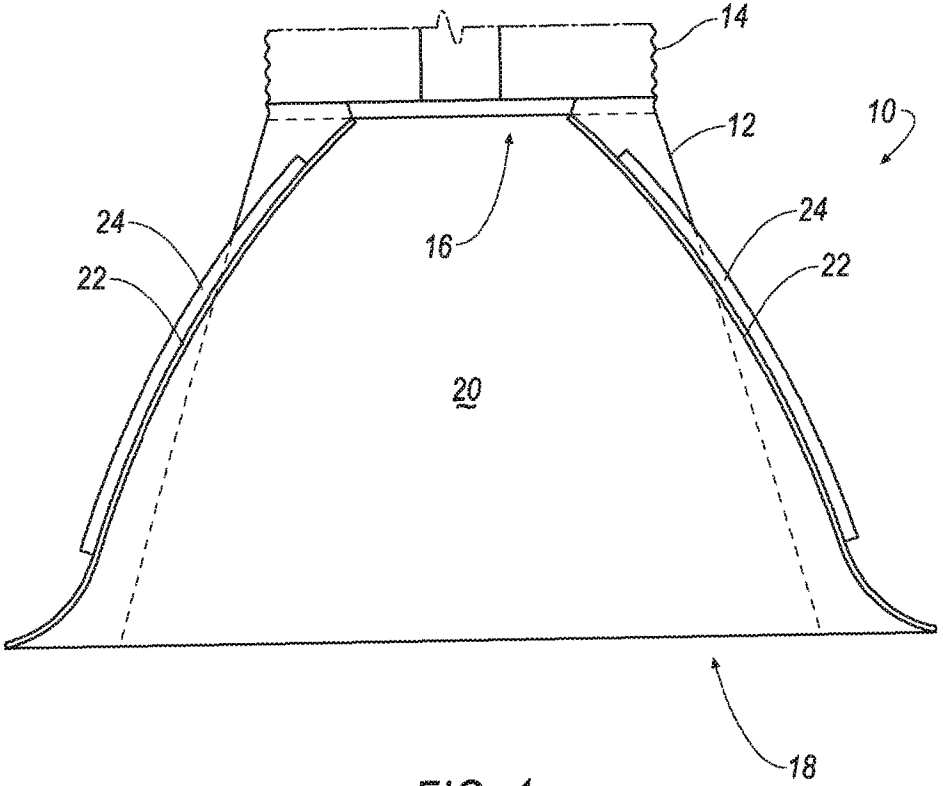
FIG. 1 is top plan view of a culvert pipe inlet arrangement.

Referring to FIGS. 1-3, a first arrangement of a culvert inlet 10 is illustrated. Culvert inlet 10 comprises a pan member 12 and an inlet section 14. The pan member 12 includes a first end 16 and a second end 18 with a body portion 20 therebetween. The pan member 12 flares outwardly from the first end 16 to the second end 18. In one exemplary arrangement, the pan member 12 has a bell shape. The body portion 20 includes a planer surface positioned between upwardly extending side walls 22 that may terminate in rolled edges 24 to provide additional rigidity to the pan member 12. The first end 16 of the pan member 12 is fixedly secure to the inlet section 14 such that the culvert inlet 10 is a unitary element.

Referring to FIG. 3, the inlet section 14 is generally configured with a shape that generally corresponds to the shape of a standard culvert pipe. For example, as illustrated in FIG. 3, inlet section 14 is generally configured with a circular cross-section. A portion 26 of the inlet section 14 may be removed from the inlet section 14 to allow selective movement of ends 28*a*, 28*b* of the inlet section 14 toward one another, to produce a smaller inlet section 14. More specifically, unlike prior art culvert inlets, the inlet section 14 is inserted into a culvert pipe. By removing portion 26, the inlet section 14 may be partially collapsed to allow easy insertion into the culvert pipe. In one exemplary arrangement, due to the configuration of the inlet section 14, a spring force of the inlet section 14 will cause the inlet section 14 to conform to the interior surface of the inlet section 14 and engage via friction fit.

In an alternative arrangement, once the inlet section 14 is disposed within the culvert pipe, a spreader rod 30 may be inserted into the inlet section 14. And exemplary arrangement of a spreader rod 30 is shown in FIG. 2. Spreader rod 30 includes a linear section 32 that includes two threaded ends 34*a*, 34*b*. A tightening sleeve 36 receives the threaded ends 34*a*, 34*b* therein. In operation, the tightening sleeve 36 may be rotated in a first direction to force the threaded ends 34*a*, 34*b* away from one another and outwardly from sleeve 36 expand the perimeter of the spreader rod 30 to secure the inlet section 14 against the interior surface of the culvert pipe. To remove the inlet section 14 from a culvert pipe, the tightening sleeve 36 may be rotated in a second direction to collapse the spreader rod 30 and remove the spread rod 30. Once removed, the inlet section 14 may be slide outwardly from the culvert pipe.

Figure 4:
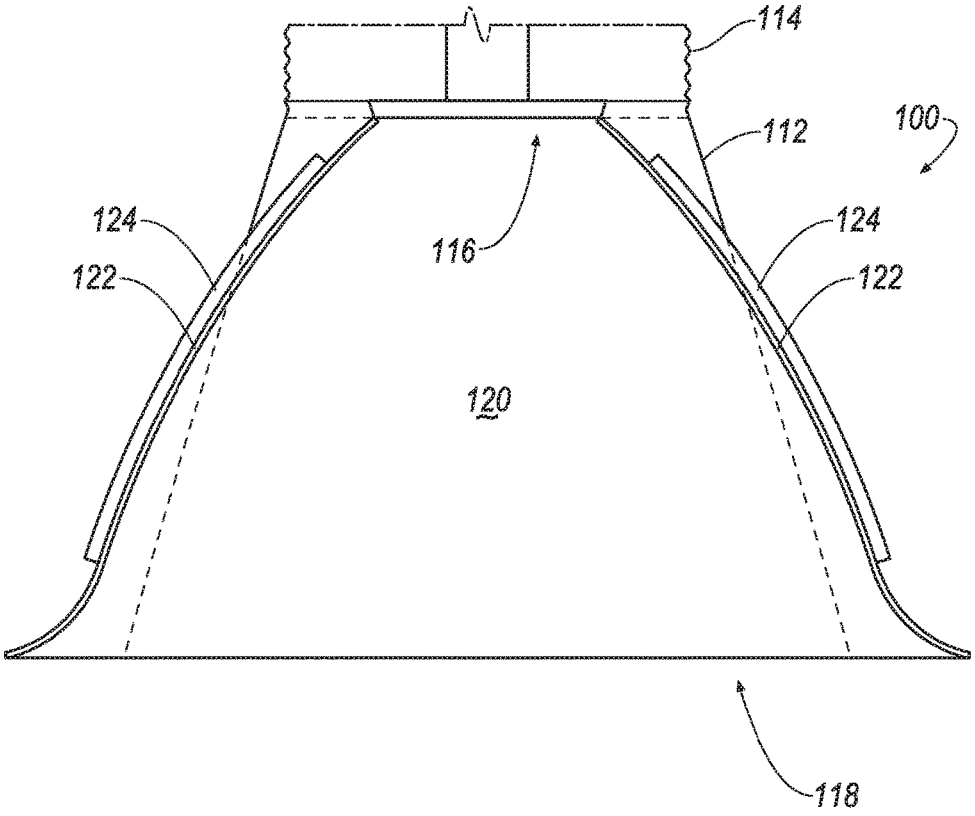
FIG. 4 is a plan view of a second embodiment of a culvert pipe inlet arrangement.
Figure 5:
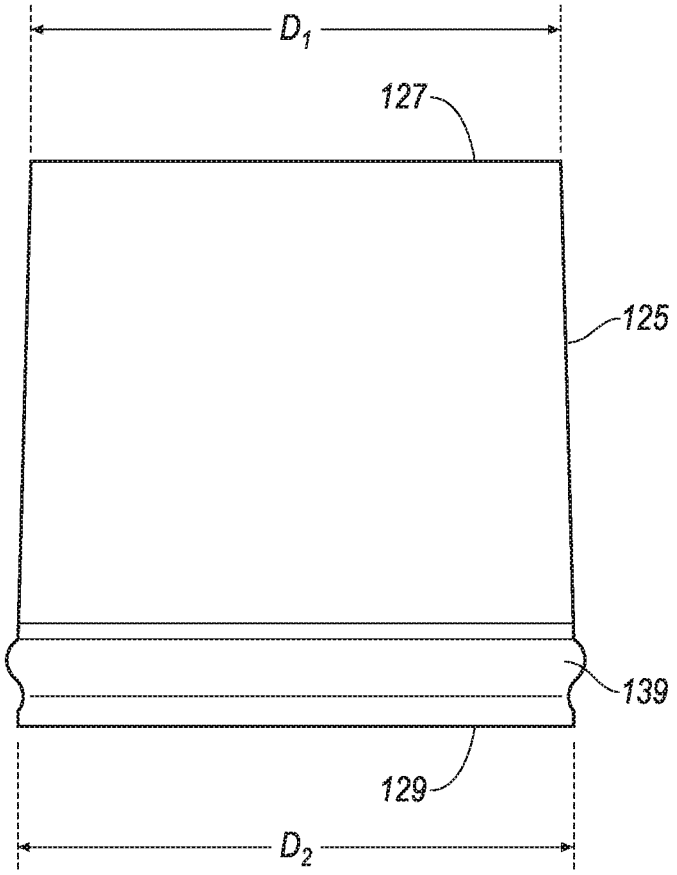
FIG. 5 is an elevational view of a sleeve for a circular pipe.
Figure 6:
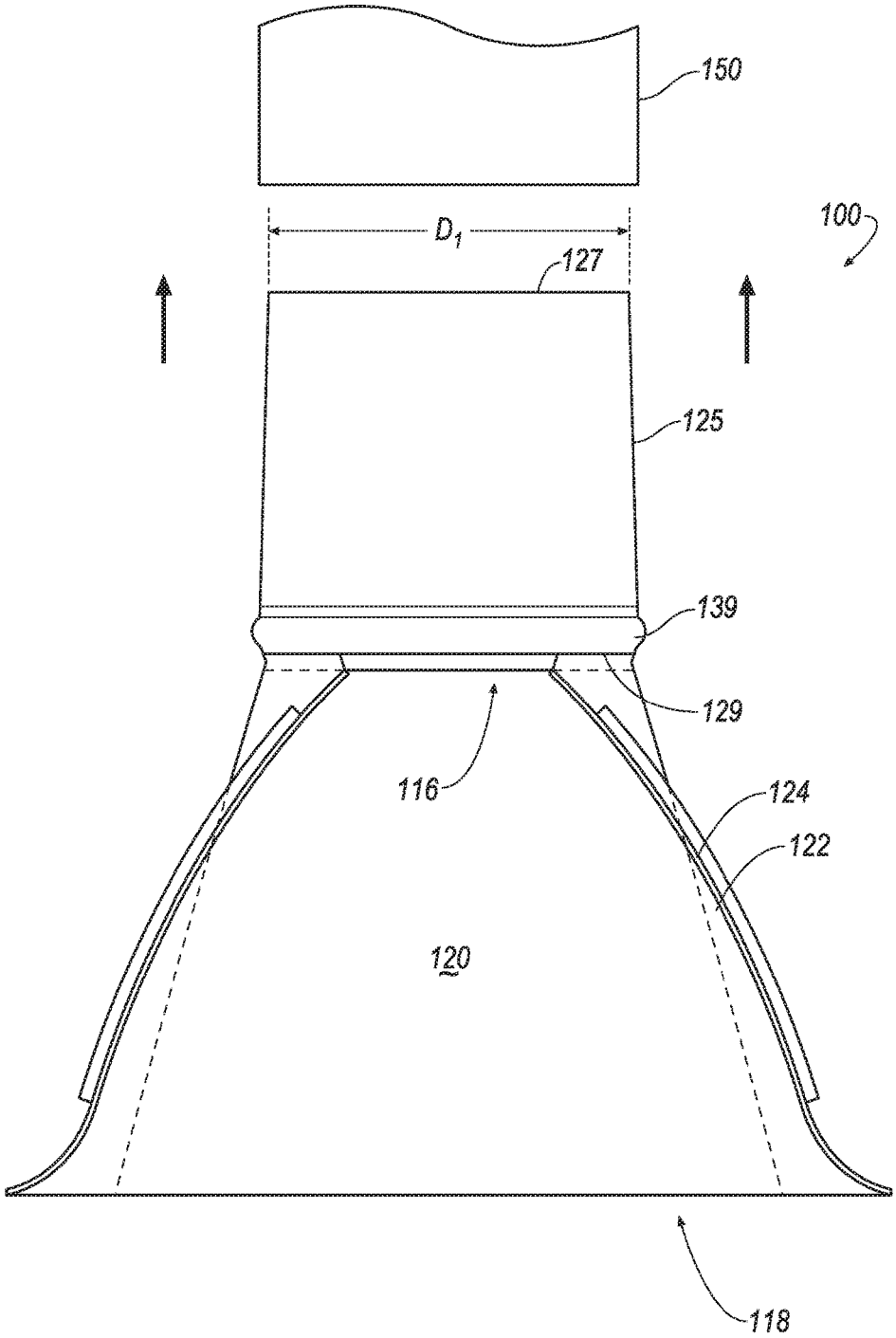
FIG. 6 is top plan view of the culvert pipe inlet arrangement, with the sleeve mounted thereto.

Referring to FIGS. 4-6, a second embodiment is illustrated of a culvert inlet arrangement 100. Culvert inlet 100 is similar to culvert inlet 10 in that it comprises a pan member 112 and an inlet section 114. The pan member 112 includes a first end 116 and a second end 118 with a body portion 120 therebetween. The pan member 112 flares outwardly from the first end 116 to the second end 118. In one exemplary arrangement, the pan member 112 has a bell shape. The body portion 120 includes upwardly extending side walls 122 that may terminate in rolled edges 124 to provide additional rigidity to the pan member 112. The first end 116 of the pan member 112 is fixedly secure to the inlet section 114.

Culvert inlet arrangement 100 further comprises a sleeve 125, which is illustrated in FIG. 5. The sleeve 125 comprises first and second ends 127, 129. First end 127 has a diameter $D_1$ that is slightly smaller than a diameter $D_2$ of the second end 129. This configuration results in sleeve 125 being slightly tapered. Adjacent to second end 129 is a section 139 that bulges outwardly. Section 139 serves as a stopper when in use. Second end 129 receives inlet section 114 therein and second end 129 is fixedly secured to the pan member 112, such as by welding, as shown in FIG. 6.

In operation, the sleeve 125 is inserted into the culvert pipe 150. Due to the tapered configuration of the sleeve 125, the sleeve 125 may easily be inserted into the culvert pipe. Section 139 may set against the open end of the culvert pipe to prevent debris from entering between the sleeve and the culvert pipe. The sleeve 125 is then fixedly secured to the culvert pipe, by suitable fasteners, to limit movement of the sleeve 125 within the culvert pipe.

The designs of the culvert inlets 10, 100 allow for the entire flow of the water entering the end section 18, 118 to flow unimpeded into the flowline of the culvert pipe. This is accomplished by installing the culvert inlets 10, 100 into the pipe instead of on the outside. This will keep the water from washing around the outside of the pipe and direct the flow of the runoff to the desired outlet, thus limiting excessive erosion.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A culvert pipe inlet arrangement for culvert pipes, comprising:

a pan member defined by first and second ends and a body portion between the first and second ends; and an inlet section connected to and extending from the first end of the pan member, wherein the inlet section has a diameter less than an internal diameter of a culvert pipe such that the inlet section is configured to be received in frictional engagement with an interior surface of the culvert pipe, the inlet section further comprising a removed portion to allow for ends of the inlet section to be selectively moved toward one another to selectively vary a diameter of the inlet section.

2. The culvert pipe inlet of claim 1, wherein the pan member flares outwardly from the first end to the second end.

3. The culvert pipe inlet of claim 1, wherein the pan member has a bell shape.

4. The culvert pipe inlet of claim 1, wherein the pan member includes upwardly extending side walls.

5. The culvert pipe inlet of claim 1, wherein the upwardly extending side walls terminate in rolled edges.

6. The culvert pipe inlet of claim 1, a spreader rod arrangement configured to be disposed within the inlet section to secure the inlet section against the interior surface of a culvert pipe.

7. The culvert pipe inlet of claim 6, wherein the spreader rod arrangement includes a linear section having first and second threaded ends, and a tightening sleeve that receives the threaded ends, wherein rotation of the tightening sleeve in a first direction forces the threads outwardly of the sleeve to expand the perimeter of the spreader rod arrangement.

8. The culvert pipe inlet of claim 1, a sleeve having first and second ends, wherein the first end is smaller than the second end such that the sleeve is tapered, and wherein the inlet section is disposed within the sleeve and the second end of the sleeve is fixed secure to the inlet section.

9. The culvert pipe inlet of claim 8, a section disposed adjacent the second end of the sleeve that extends outwardly to form a stopper.

10. A culvert pipe inlet arrangement for use with culvert pipes, comprising:

a pan member defined by first and second ends and a body portion between the first and second ends;

an inlet section connected to the first end of the pan member, wherein the inlet section having a continuous diameter; and a sleeve having first and second ends, wherein the first end is smaller than the second end such that the sleeve is tapered, further comprising a section disposed adjacent the second end of the sleeve that extends outwardly from the outermost diameter of the sleeve to form a stopper, and wherein the inlet section is disposed within the sleeve and the second end of the sleeve is secured to the inlet section.

11. The culvert pipe inlet of claim 10, wherein the pan member flares outwardly from the first end to the second end.

12. The culvert pipe inlet of claim 10, wherein the upwardly extending side walls terminate in rolled edges.

13. The culvert pipe inlet of claim 10, wherein the sleeve is fixedly connected to the inlet section.

* * * * *